US007136614B2

(12) United States Patent
Kang et al.

(10) Patent No.: US 7,136,614 B2
(45) Date of Patent: Nov. 14, 2006

(54) DUPLEX PRINTER

(75) Inventors: Il-kwon Kang, Suwon-si (KR); Hyo-jin Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 196 days.

(21) Appl. No.: 10/878,522

(22) Filed: Jun. 29, 2004

(65) Prior Publication Data

US 2005/0019067 A1 Jan. 27, 2005

(30) Foreign Application Priority Data

Jul. 24, 2003 (KR) ..... 10-2003-0051107

(51) Int. Cl.
*G03G 15/22* (2006.01)

(52) U.S. Cl. ..... 399/306; 399/401

(58) Field of Classification Search ..... 399/309, 399/306, 401, 400, 303, 107
See application file for complete search history.

(56) References Cited

U.S. PATENT DOCUMENTS 4,456,237 A 6/1984 Buddendeck ..... 271/3.1
2003/0108359 A1 6/2003 Chung ..... 399/124
2004/0037601 A1* 2/2004 Uchida et al. ..... 399/401 X

FOREIGN PATENT DOCUMENTS

| | | |
|---|---|---|
| JP | 61151637 | 7/1986 |
| JP | 008156 | 1/1989 |
| KR | 013879 | 7/1993 |
| KR | 00147573 B1 | 5/1998 |

* cited by examiner

*Primary Examiner*—David M. Gray
*Assistant Examiner*—Erika J. Villaluna
(74) *Attorney, Agent, or Firm*—Roylance, Abrams, Berdo & Goodman, L.L.P.

(57) ABSTRACT

Provided is a duplex printer and method of duplex printing. The duplex printer and method of printing includes a paper feeding belt that is vertically installed to form a first vertical surface; a photosensitive drum that is installed to contact the first vertical surface; and a transfer roller that is installed to contact an other surface of the first vertical surface contacting the photosensitive drum to transfer a toner image from the photosensitive drum onto a sheet of paper, which is supplied between the photosensitive drum and the paper feeding belt. A back surface feeding path of the paper is formed at an opposite side of the photosensitive drum in the paper feeding belt, and the paper is conveyed closely adhered to a surface of the paper feeding belt in the back surface feeding path of the paper.

8 Claims, 2 Drawing Sheets

DUPLEX PRINTER

PRIORITY

This application claims the benefit under 35 U.S.C. §119 (a) of Korean Patent Application No. 2003-51107, filed on Jul. 24, 2003, in the Korean Intellectual Property Office, the entire disclosure of which is incorporated herein by reference.

BACKGROUND OF THE INVENTION

1. Field of the Invention

The present invention relates to a duplex printer that prints images on both surfaces of a sheet of paper. More particularly, the present invention relates to a photoelectrographic printer for duplex printing, which uses a paper conveying belt for conveying the paper when a front surface and a back surface of the document are printed.

2. Description of the Related Art

In general, a printer using an electrophotographic method is a device that forms an electrostatic latent image by irradiating light on a photosensitive medium charged to a predetermined electric potential, develops the electrostatic latent image with a toner of a predetermined color using a developing apparatus, and transfers and fixes the image on a sheet of paper to print a mono-color image or full-color image.

The electrophotographic printer can be classified into a wet type and a dry type electrophotographic printer according to a type of developer. The wet type electrophotographic printer uses a developer in which liquid carrier includes distributed powder toner. The dry type electrophotographic printer uses a binary developer including a powder type carrier and a toner or a unitary developer including the toner only. Hereinafter, the dry type electrophotographic printer will be described, and the developer will be referred to as toner.

In order to print a full-color image, yellow (Y), magenta (M), cyan (C), and black (K) toner colors are required, thus four developing devices that develop the four color toners are required. To form a full-color image, two methods can be used. The first is a single path method, wherein a transfer substance passes through photosensitive substances on which four color images are formed and the color images on the photosensitive substances are sequentially transferred. The second is a multi-path method, in which when a transfer substance passes through photosensitive substances, an image on the photosensitive substances is transferred from only one photosensitive substance and the transferring process is repeated to form a full-color image. In both methods, four developing devices are required.

To print a color image, the multi-path method requires a processing time four times longer than for printing a mono-color image, however, the structure of a printing apparatus is simple. On the other hand, in the single-path method, the printing time to print a mono-color image or a full-color image is same, and color printing can be performed with high speed.

FIG. 1 is a schematic view illustrating a conventional electrophotographic image forming apparatus using the single-path method.

Referring to FIG. 1, the image forming apparatus includes a light scanning unit 20 that scans light onto a photosensitive drum 10, which is charged to a predetermined electric potential, to form an electrostatic latent image, four developing devices 30 that develop the electric latent image with four color toners (Y, M, C, and K) to form toner images on the photosensitive drums 10, a feeding belt 40 that conveys a sheet of paper, on which the toner images of four colors formed on the photosensitive drums 10 are transferred sequentially, and a fusing device 50 that fixes the image onto the paper by heating and pressing the paper on which the toner images are transferred. A paper feeding cassette 60 that feeds the paper (P) is installed to be input in and output from a main body of the image forming apparatus, and the paper placed on the paper feeding cassette 60 enters a printing path by a pickup roller 70. A developing roller 31 is disposed on a front end of the developing device 30, and the developing roller 31 develops the latent image on the photosensitive drum 10. The photosensitive drum 10 and the developing devices 30 are disposed horizontally, and perform the color printing process in the single-path method to form a compact type image forming apparatus. Reference numeral 11 denotes transfer rollers corresponding to the photosensitive drums to transfer the toner images on the photosensitive drums on the paper (P). A voltage having different polarity from that of a toner is applied to the transfer rollers 11.

On the other hand, U.S. Published Application Ser. No. 2003/108359, which is incorporated herein by reference, discloses a duplex printer, in which a single printing path and a duplex printing path are formed using guide plates. In this case, a transfer process is performed in a horizontal direction, and a space for a plurality of photosensitive drums is required to perform color printing. Thus, it is difficult to construct a compact color printer. Also, the above duplex printer has a complex structure that includes upper and lower plates, which guide the paper for making the paths for printing on a back surface of a sheet of paper, a roller for conveying the paper between the plates, and a gear train for actuating the roller.

Therefore, it is desirable that the color printing is performed on a vertical plane to make a compact duplex printer, and a paper feeding belt as shown in FIG. 1 can be used.

SUMMARY OF THE INVENTION

The present invention provides a duplex printer, in which a paper feeding belt is vertically installed, and a side is used as a printing path and other side is used as a back surface printing path.

According to an aspect of the present invention, there is provided a duplex printer including a paper feeding belt that is vertically installed to form a first vertical surface, a photosensitive drum that is installed to contact the first vertical surface, and a transfer roller that is installed to contact another surface of the first vertical surface contacting the photosensitive drum to transfer a toner image from the photosensitive drum onto a sheet of paper, which is supplied between the photosensitive drum and the paper feeding belt. A back surface feeding path of the paper is formed at an opposite side of the photosensitive drum in the paper feeding belt, and the paper is conveyed closely adhered to a surface of the paper feeding belt in the back surface feeding path.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
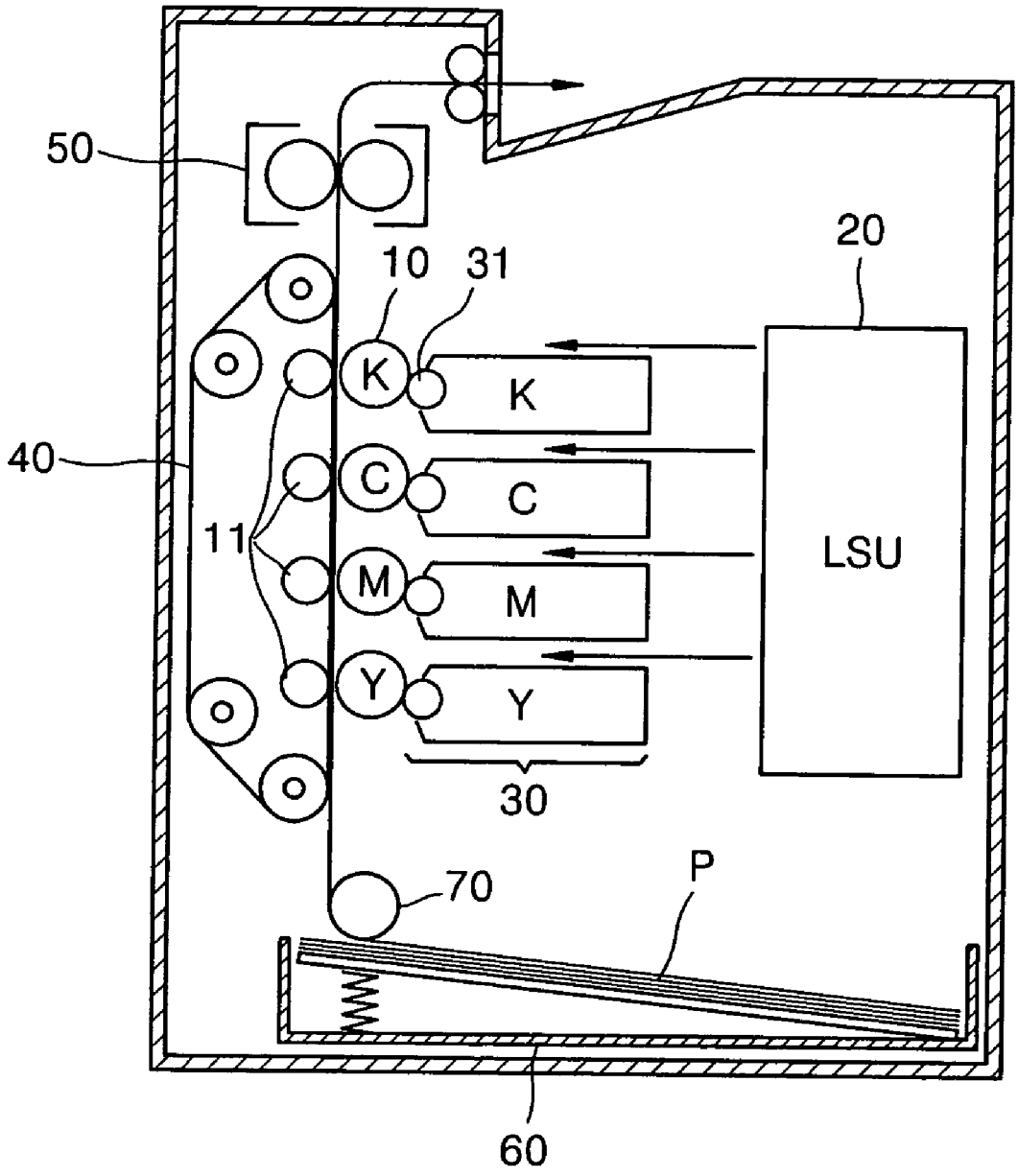
FIG. 1 (PRIOR ART)
FIG. 1 is a schematic view illustrating a conventional electophotographic image forming apparatus using a single-path method.
Figure 2:
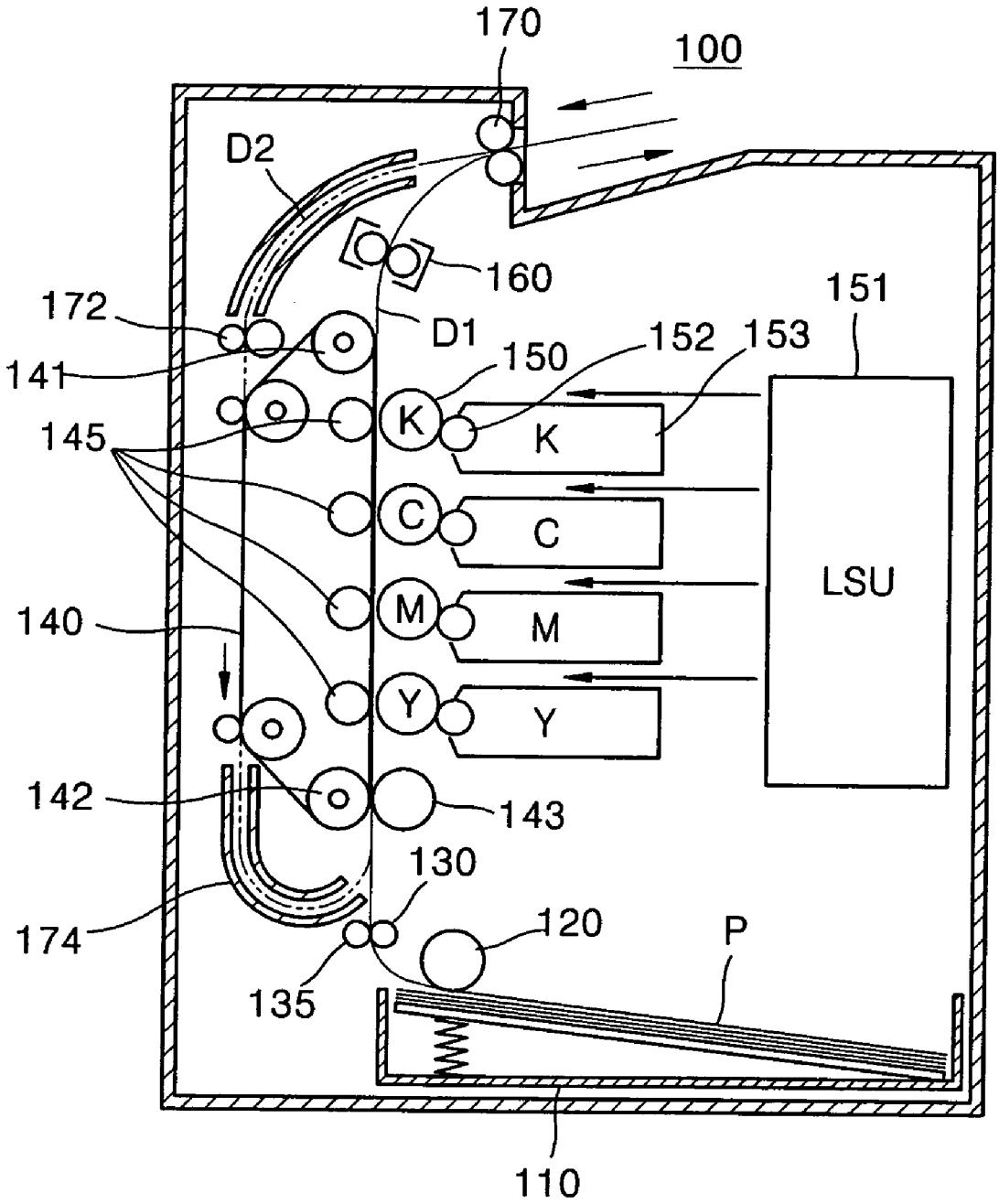
FIG. 2 is a schematic side view illustrating a duplex printer according to an embodiment of the present invention.

FIG. 2 is a schematic side view illustrating a duplex printer according to an embodiment of the present invention.

Referring to FIG. 2, a paper cassette 110 for storing a plurality of sheets of paper is installed in a main body of a duplex printer 100 so as to be attachable and detachable to and from the main body. In addition, a pickup roller 120, is rotatably installed in the main body of the printer 100 to contact a front end portion of the uppermost paper in the paper cassette 110. Therefore, when the pickup roller 120 rotates, a sheet of paper is picked up due to the frictional force between the pickup roller 120 and the paper, and enters between a feeding roller 130 and a double feed prevention roller 135. The double feed prevention roller 135 rotates while contacting the feeding roller so that the uppermost paper only can be transferred when two or more sheets of paper are fed by the pickup roller 120. In more detail, the double feed prevention roller 135 is basically installed to rotate in an opposite direction to the feeding roller 130 with a smaller torque than that of the feeding roller 130. However, since the double feed prevention roller 135 contacts the feeding roller 130, the double feed prevention roller 135 rotates in a paper proceeding direction as a torque of the feeding roller 130 is larger when there is no paper or only a sheet of paper between the double feed prevention roller 135 and the feeding roller 130. When two or more sheets enter between the double feed prevention roller 135 and the feeding roller 130, the double feed prevention roller 135 rotates in an opposite direction to the paper proceeding direction without being affected by the rotating force of the feeding roller 130 due to a low frictional force between the sheets. Accordingly, the sheets under the uppermost paper contacting the feeding roller 130 are prevented from being conveyed in the proceeding direction by the double feed prevention roller 135.

The paper passing through the feeding roller 130 and the double feed prevention roller 135 enters a printing area. A circulating paper feeding belt 140 is vertically installed in the printing area, and is supported by a driving roller 141, a driven roller 142, and a plurality of additional rollers. Photosensitive drums 150, which are developed with yellow (Y), magenta (M), cyan (C), and black (K) toner colors are disposed on a surface of the paper feeding belt 140 in series, and surfaces of the photosensitive drums 150 contact the surface of the paper feeding belt 140. Transfer rollers 145 corresponding to the photosensitive drums 150 are disposed on an other surface of the paper feeding belt 140 to transfer the toner images on the photosensitive drums 150 on the paper entering between the photosensitive drum 150 and the transfer roller 145. A light scanning unit (LSU) 151 that scans the light onto the photosensitive drum 150 to form the electric latent image is disposed at a side of the photosensitive drums 150, and developing devices 153 including developing rollers 152, which develop the electric latent image on the photosensitive drums 150, are disposed between the photosensitive drums 150 and the light scanning unit 151. On the other hand, reference numeral 143 denotes a first charging roll to charge the paper entering the printing area so that the paper will closely adhere to the surface of paper feeding belt 140 while being conveyed.

The toner image transferred on the paper is heated and pressed in the fusing device 160 to be fixed on the paper. The paper passing through the fusing device 160 is conveyed toward a reversible roller 170.

In a case where the image is only printed on the front surface of the paper P, the paper P passing the fusing device 160 is discharged out of the printer main body by the reversible roller 170. Here, the reversible roller 170 rotates in the discharging direction of the paper P so as not to interrupt the discharging operation of the paper. On the other hand, in a case where the image is printed on both surfaces of the paper, the rotating direction of the reversible roller 170 is changed as will be described in greater detail below.

In a case where the image is printed on both surfaces of the paper P, the proceeding direction of the paper P is changed by the reversible roller 170, which rotates in an opposite direction to the discharging direction, to print the paper P on a back surface thereof. Accordingly, the paper P enters a second paper feeding path D2, which is a supplying path for printing on the back surface of the paper, from the first paper feeding path D1, which is the supplying path for printing on the front surface of the paper. The paper P entering the second paper feeding path D2 is charged by the second charging roll 172, thus the paper P closely adheres to the surface of the feeding belt 140 due to the electrostatic force between the paper and the paper feeding belt 140 when the paper P passes through the surface of the paper feeding belt 140. The paper passes the paper feeding belt 140 and enters the first paper feeding path D1 after passing a paper guide 174 so that the back surface printing operation is performed. Since the above back surface printing process is basically the same as the front surface printing process described above, detailed descriptions for the process will be omitted.

The paper feeding path may be constructed so that a sheet of paper that passes the guide 174 enters between the feeding roller 130 and the double feed prevention roller 135.

As described above, in the electrophotographic printer for duplex printing according to an embodiment of the present invention, the paper feeding belt is vertically installed and the photosensitive drums and developing devices for four toner,colors are horizontally piled up on a side of the paper feeding belt, thus a compact color printer can be formed. In addition, since the paper feeding belt is used as the second paper feeding path, the number of additional guide plates and convey rollers can be omitted, and a compact color printer can be fabricated.

While the present invention has been particularly shown and described with reference to exemplary embodiments thereof, it will be understood by those of ordinary skill in the art that various changes in form and details may be made therein without departing from the spirit and scope of the present invention as defined by the following claims and equivalents thereof.

What is claimed is:

1. A duplex printer comprising:

a paper feeding belt that is vertically installed to form a first vertical surface;

a photosensitive drum that is installed to contact the first vertical surface; and a transfer roller that is installed to contact an other surface of the first vertical surface contacting the photosensitive drum to transfer a toner image from the photosensitive drum onto a sheet of paper, which is supplied between the photosensitive drum and the paper feeding belt, wherein a back surface feeding path of the paper is formed at an opposite side of the photosensitive drum in the paper feeding belt, and the paper is conveyed adhered to a surface of the paper feeding belt in the back surface feeding path of the paper.

2. The duplex printer of claim 1, further comprising:

a charging roll that charges the paper at an upstream of the paper feeding belt in the back surface feeding path of the paper.

3. The duplex printer of claim 1, wherein a second vertical surface forming the back surface feeding path is formed on an opposite side of the first vertical surface of the paper feeding belt, and the paper is conveyed adhered to the second vertical surface.

4. A duplex printer comprising:

a paper feeding belt that is vertically installed to form a first vertical surface;

a plurality of photosensitive drums for various colors that contact the first vertical surface; and a plurality of transfer rollers that are installed on an opposite side of the first vertical surface and contact the photosensitive drums to transfer toner images from the photosensitive drums onto a sheet of paper fed between the photosensitive drum and the paper feeding belt, wherein a back surface feeding path of the paper is formed at an opposite side of the photosensitive drums in the paper feeding belt, and the paper is conveyed adhered to a surface of the paper feeding belt in the back surface feeding path of the paper.

5. The duplex printer of claim 4, further comprising:

a charging roll that charges the paper at an upstream of the paper feeding belt in the back surface feeding path of the paper.

6. The duplex printer of claim 4, wherein a second vertical surface forming the back surface feeding path is formed on an opposite side of the first vertical surface of the paper feeding belt, and the paper is conveyed adhered to the second vertical surface.

7. A method of printing comprising the steps of:

feeding a sheet of paper along a first vertical surface of a paper feeding belt, and printing an image onto a first surface of the sheet of paper;

reversing a direction of an exhaust roller to feed said sheet of paper into a back surface feeding path;

feeding said sheet of paper adhered to a second vertical surface of said paper feeding belt;

transferring said sheet of paper to said first vertical surface of said paper feeding belt; and printing onto a second surface of said sheet of paper.

8. The method of printing of claim 7, further comprising the step of charging said sheet of paper so that said sheet of paper adheres to said second vertical surface of said paper feeding belt.

* * * * *